United States Patent [19]

Geyer et al.

[11] 4,325,972

[45] Apr. 20, 1982

[54] PERFLUORINATED N,N-DIMETHYL CYCLOHEXYLMETHYLAMINE EMULSIONS

[75] Inventors: Robert P. Geyer, Brookline, Mass.; Frederick L. Herman, Allentown, Pa.

[73] Assignee: Air Products and Chemicals, Inc., Allentown, Pa.

[21] Appl. No.: 278,934

[22] Filed: Jun. 30, 1981

Related U.S. Application Data

[62] Division of Ser. No. 153,235, May 27, 1980.

[51] Int. Cl.[3] ..... A61K 31/13

[52] U.S. Cl. ..... 424/325

[58] Field of Search ..... 424/325

[56] References Cited

U.S. PATENT DOCUMENTS 3,989,843 11/1976 Chabert et al. ..... 424/325

OTHER PUBLICATIONS

Riess et al.-Angewante Chemie Intl. Ed. in English, vol. 17, No. 9 (1978), pp. 621-633.

*Primary Examiner*—Sam Rosen

*Attorney, Agent, or Firm*—William F. Marsh; E. Eugene Innis

[57] ABSTRACT

Benzyl dimethyl amine is subject to electrofluorination in anhydrous HF to produce perfluoro-N,N-dimethyl-cyclohexylmethylamine. The obtained perfluoro compound is emulsified with the aid of a nonionic surfactant to form a stable emulsion showing promising use for administration as a blood substitute.

7 Claims, No Drawings

PERFLUORINATED N,N-DIMETHYL CYCLOHEXYLMETHYLAMINE EMULSIONS

The invention described herein was made in the course of or under a contract with the U.S. Department of Health, Education, and Welfare.

This is a division, of application Ser. No. 153,235, filed May 27, 1980.

BACKGROUND OF THE INVENTION

Considerable research has been conducted in the use of perfluorinated compounds as oxygen and $CO_2$ carriers in so-called "artificial blood" or blood substitutes. A comprehensive survey of the state of the art was published by Riess, J. G. et al. in Angewandte Chemie, International Edition in English, Vol. 17, pages 621–634 (September, 1978), which includes an extensive bibliography of prior publications. While the ability of perfluorinated compounds to function as blood substitutes has been conclusively demonstrated, search for the ideal compound or compounds best suited for the various situations in which blood substitutes can be employed is continuing. Research in the area of blood substitutes has been hampered, however, by the lack of commercial availability of prospective inert fluorocarbons.

Most of the previous investigations have been carried out with three commercially available perfluoro compounds:

(I) a product of the 3M Company designated FX-80, a mixture of fluorinated products including perfluoro 2-butyl tetrahydrofuran;

(II) Perfluorotributyl amine (III) Perfluorodecalin.

To quality as a component of blood substitute compositions, a fluorocarbon candidate compound must possess the following properties:

(a) inertness (b) emulsifiability (c) intermediate vapor pressure (d) be nonaccumulative in tissues.

The pure fluorocarbon can not be used as such as a blood substitute because it will not dissolve salts, proteins and other biological materials. The fluorocarbon compound, accordingly, is emulsified in water with the aid of certain emulsifying agents. Stability of the emulsion on storage and in vivo are necessary criteria to be met by a successful blood substitute. While the compounds (I) and (II) identified above form stable emulsions, compound (III) does not.

The ideal candidate must also exhibit an intermediate vapor pressure at biological temperatures. The fluorocarbon should be slowly expirated from the body as natural blood is being regenerated. While this is facilitated with compounds of higher vapor pressure, unfortunately, excessively high vapor pressure, as is the case with compound (I), results in pulmonary edema, rendering such compounds undesirable.

The desired fluorocarbon compound should be one that does not accumulate in body organs after it is removed from the blood. Thus, while compound (II) forms stable emulsions, it is not deemed suitable as a viable candidate for a blood substitute because it is retained by the liver.

One theory that has been advanced to explain the observations cited above attributes the emulsifiability of compounds (I) and (II) to the presence of the heteroatom therein. Compound (III) has no heteroatom and is therefore not capable of forming a stable emulsion. However, the same factor which influences emulsification has also been blamed for causing retention of the compounds in various body organs. An alternative theory attributes fluorocarbon retention to the relative vapor pressure of the compounds, and correlations have been developed which demonstrate that compounds with higher vapor pressure have faster expiratory excretion.

A better understanding of the mechanism of fluorocarbon retention would enable the synthesis of fluorocarbons possessing all the properties required for an artificial blood substitute. Accordingly, under contracted sponsorship by the National Heart and Lung Institute of the Public Health Service, HEW, a project was undertaken by Harvard University and Air Products and Chemicals, Inc. for the synthesis of a wide variety of heteroatomic fluorocarbons by electrochemical fluorination and the screening of these compounds in synthetic blood preparations. Preparation of emulsions of these synthesized fluorocarbons and their testing in vivo would be useful in differentiating the postulated mechanisms of fluorocarbon retention.

In carrying out the synthesis of the program, 17 organic compounds, falling in 8 chemical classes, were electrochemically fluorinated, resulting in 24 samples submitted for biological evalulation. Only two of the compounds prepared in this program showed promise as oxygen transport media in blood substitute compositions, warranting further extensive evaluation; one of these being the compound claimed in the present patent application.

The electrofluorination of various organic compounds is described in U.S. Pat. No. 2,616,927. Included among the compounds of this patent is the electrofluorination of aromatic amines to the corresponding cyclic fluorinated amines. For example, N,N-dimethyl aniline is converted to perfluoro-N,N-dimethyl cyclohexylamine. Relying on this disclosure, it was attempted in the experimental program leading to the present invention, to produce perfluorodicyclohexyl ether by electrofluorination of diphenyl ether. The electrolysis proceeded only with difficulty and at low current density. Examination of the reactor contents at the conclusion of the run showed that a large amount of polymeric partially fluorinated solid was produced.

The fluorination of aromatic amines to the corresponding perfluorocyclohexyl amines is also described in U.S. Pat. No. 2,616,927. An attempt to produce perfluoro-N,N-dibutyl cyclohexyl amine by electrofluorination of dibutyl aniline proved unsuccessful. Since cell fouling is especially pronounced with aromatic substrates, a small amount of ethyl thioacetate was included during the electrofluorination of the dibutyl aniline. Despite this reported remedy to prevent fouling (per U.S. Pat. Nos. 3,028,321 and 3,692,643), the electrofluorination proceeded only with difficulty at low current densities and no liquid fluorocarbon layer was found at the end of the run.

In like manner, in the initial attempt to fluorinate dimethyl aniline, no liquid fluorocarbon product was obtained. With a second charge of the dimethyl aniline some fluorocarbon was obtained but GC analysis indicated that the product was a complex mixture which was not alkali stable, the main component decreasing in concentration during the standard alkali work-up procedure employed in the attempted purification of the crude cell product. Accordingly, no further attempt was made to produce perfluorinated cyclohexyl amines by electrofluorination of aromatic amines.

The results of electrical fluorination of N,N-dimethyl aniline and N,N-dimethyl cyclohexyl amine are reported by Plashkin, V.S. et al, J. Org. Chem (USSR) Vol. 6, pp 1010–1014 (1970). The electrofluorination of these compounds as reported was accompanied by cleavage of the carbon-carbon bond giving rise to the accompanying production of perfluoro-N,N-dimethyl-n-hexyl amine.

The prior literature on perfluorinated compounds as oxygen carriers in compositions intended as blood substitutes is extensively reviewed in the above-cited paper by Riess et al and the cited bibliography. Proposed blood substitute compositions containing emulsified perfluorocarbon compounds are also described in U.S. Pat. Nos. 3,962,439 and 3,989,843. Among the compounds therein disclosed as oxygen transfer compounds are: perfluoroalkyl cyclohexanes having 3 to 5 carbon atoms in the alkyl group, perfluoro diethylcyclohexylamine and perfluorinated alkylamines. According to U.S. Pat. No. 3,962,439, it is important that the emulsions of the fluorocarbon compounds be substantially free of particles above 0.4 microns and preferably the emulsion should consist of particles below 0.3 microns, particularly when these are intended for use by injection in mammals as a blood substitute.

SUMMARY OF THE INVENTION

In accordance with the present invention, perfluoro-N,N-dimethyl cyclohexylmethyl amine is made by the electrofluorination of N,N-dimethyl benzyl amine in anhydrous liquid HF. The obtained product was found to be readily emulsifiable, providing a stable emulsion. Biological testing indicates that the compound of the invention finds utility as a component of blood substitute compositions.

DETAILED DESCRIPTION

In the program leading to the present invention, a number of starting organic compounds containing a heteroatom were subjected to flourination. These included alkyl sulfides, alkyl ethers, tertiary alkyl amines, dialkyl anilines, dimethyl benzylamine, methylamine, dimethyl cyclohexyl amine, and several heterocyclic compounds containing only nitrogen or nitrogen and oxygen as the heteroatoms.

Among perfluoro compounds synthesized in carrying out the program, were:

| | |
|---|---|
| Perfluoro-N,N-dimethyl-n-hexylamine<br>$F_3C(CF_2)_5—N(CF_3)_2$ | (IV) |
| Perfluoro-N,N-dimethyl cyclohexyl amine<br> 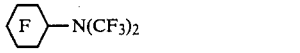 | (V) |
| Perfluoro-N,N-dimethyl cyclohexylmethyl amine<br> | (VI) |

The equipment employed in the fluorination was a jacketed Monel reactor through which glycol coolant could be circulated for temperature control. Flow of coolant was regulated by a Research Control Valve equipped with a Foxboro pneumatic controller. Power was supplied to the cell pack by a Hewlett-Packard 0–50 amp, 0–24 DC power supply. The cell pack consisted of 12 nickel plates separated with Teflon spacers, and arranged so that the odd numbered plates were anodes and the even numbered plates were cathodes. The spacing between plates was approximately 1 cm. The reactor was fitted with a 3 ft. Monel condenser through which coolant was circulated by a 0.6 ton refrigeration unit. The progress of the electrolysis was monitored by a current integrator-recorder.

The fluorination reaction was carried out in anhydrous liquid HF. The HF was vaporized from a supply cylinder, condensed in a copper coil immersed in dry ice-acetone and charged to the reactor. The substrate charge was slowly added to the reactor. A nitrogen purge was maintained over the reaction and electrolysis was begun at 30 amps, 6 volts. The formed insoluble product was drained from the reactor. The results of the electrofluorination reactions on certain of the compounds tested are set out in Table 1 below.

The same general procedure was employed in synthesizing each of the fluorochemicals included in the program. The preparation of the compound of this invention is described in Example 1.

EXAMPLE 1

Six liters of anhydrous HF were placed in the reactor and 500 g of benzyldimethylamine was carefully added thereto. The cell was maintained at 7°–12° C. under a nitrogen purge, while electrolysis was begun at 30 amps and 6 volts. As conversion to the fluorocarbon progressed, the cell current dropped. Product was drained from the bottom of the reactor and a fresh portion of the substrate was added. A total of 1500 g of benzyldimethylamine resulted in 497.8 g of fluorocarbon liquid containing 52.5% of the desired product. Fractional distillation afforded substantially pure product as a colorless liquid boiling at 124° C.

While, in general, electrolysis may be conducted over a temperature range of minus 20 to plus 20° C., the preferred range is 5°–20° C. The concentration of substrate may be 1–20%, preferably about 5–10%. The cell voltage may be in the range of 4 to 8 volts, with 5–7 volts being preferred.

TABLE 1

| | Substrate | Fluorocarbon Yield (%) (1) | GC Purity % (2) | Yield of Desired Product % (3) | Identified by-products Yield |
|---|---|---|---|---|---|
| (A) | N,N-dimethyl n-hexyl amine | 20 | 84.1 | 16.8 | |
| (B) | N,N-dimethyl cyclohexyl amine | 46.1 | 84(4) | 12.9 | Perfluoro N,N-dimethyl n-hexyl amine (25.8%) |
| (C) | N,N-dimethyl aniline(5) | 44.1 | 55 | (8) | |
| (D) | N,N-dibutyl aniline(6) | 0 | — | 0 | |
| (E) | N,N-dimethyl benzyl amine(7) | 9.1 | 53 | 4.8 | |

(1)Fluorocarbon yield is the total weight of fluocarbon produced divided by the theoretical weight assuming 100% conversion to the desired product.
(2)As measured by area on gas chromatograph.
(3)Fluorocarbon yield(1) multiplied by GC purity(2). Desired product is the perfluorinated compound possessing the same carbon skeleton as its corresponding starting material.
(4)NMR shows 2:1 ratio of perfluoro N,N-dimethyl cyclohexyl amine and perfluoro N,N-dimethyl n-hexyl amine.
(5)Contained 3% ethyl thioacetate to inhibit fouling.
(6)5% ethyl thioacetate added.
(7)Commercially available grade - as received.
(8)The composition of the crude product mixture changed during base reflux resulting in lower amounts of major component, and an inseparable mixture.

The standard procedure used to purify the crude cell product involved refluxing the fluorocarbon over 30% KOH, followed by distillation. The KOH reflux was conducted for 24 hours and was repeated until the gas chromatogram of the product showed no further changes. This was followed by either a simple or spinning band distillation, depending on the complexity of the mixture and the purity desired.

The GC anaylses were performed on a Perkin Elmer Model 910 gas chromatograph. The $^{19}F$ NMR spectra were recorded in fluorotrichloromethane on a Perkin Elmer Model R12B spectrometer operating at 56.4 MHZ.

The NMR spectra and physical properties of the above perfluorinated compounds are set out in Table 2. Chemical shift values are based relative to $FCCl_3$ internal standard.

TABLE 2

| Perfluoro Cmpd. from | $^{19}F$ NMR Spectrum Chemical Shift (ppm) | Multiplicity | Assignment | b.p. °C. | Lit b.p. °C. |
|---|---|---|---|---|---|
| A | −120 to −127 | m | —CF2— | 103°-104° | |
| | −90.3 | m | $—CF_2N—$ | | |
| | −81.6 | m | $—CF_3$ | | |
| | −52.9 | m | $N—CF_3$ | | |
| B | −155.0 | m | C—F | 104° | 110-111° U.S. Pat. No. 2,616,927 |
| | −115-146 | m | $—CF_2—$ | | |
| | −49.9 | m | $N—CF_3$ | | |
| E | −182.0 | m | C—F | 124° | |
| | −116 to −146 | m | $—CF_2$ | | |
| | −79.6 | m | $—CF_2N—$ | | |
| | −52.6 | m | $—CF_3$ | | |

Samples of the various perfluorinated compounds synthesized in carrying out the program were purified and screened in synthetic blood preparations. Among other properites determined in such screening, note was made of boiling points and degree of purity as determined by gas chromatography. The structures and purity of the fluorinated compounds were confirmed by infrared and NMR spectroscopy.

Among the primary concerns in utilizing perfluorochemicals for biological oxygen transport purposes is facility of emulsification and the stability of the resulting emulsions. Emulsification was carried out by sonication of the sample in a solution of Pluronic F-68 as the emulsifying agent. Emulsification was terminated when microscopic examination showed most of the particles to be less than 0.3 micron in diameter with few larger than 0.5 micron, if obtainable. Otherwise, emulsification was continued until no readily discernible change in particle size distribution could be detected. Certain of the tested compounds were precluded from consideration as synthetic blood components because they liberated relatively high concentrations of fluoride ion during sonication. These compounds might be further considered if they could be emulsified by high pressure homogenization.

The obtained emulsions were sterilized by filtration through 0.22 micron Millipore membrane filters and stored at 4° C. Samples of the emulsions were subjected to physical stability tests and rated. Only those emulsions that showed no obvious gross or microscopic changes were considered stable.

Results of the emulsification and stability tests of emulsions containing the compound of the present invention and emulsions containing certain of the other synthesized compounds of related structure, are set out in Table 3. In general, depending upon intended use, the emulsion may contain 5 to 35% by volume of the perfluorinated compound. While the particular example shows the use of Pluronic F-68 surfactant, it is understood that other known compatible nonionic surfactant emulsifying agents may be employed in the invention.

TABLE 3

| Perfluoro- | Emulsification Ease | Approx. Particle Size | Stability on Storage | Stability to Electrolytes |
|---|---|---|---|---|
| N,N-dimethyl cyclohexylamine | No difficulty | 0.3 | Good | Good |
| N,N-dimethyl-n-hexyl amine | No difficulty | 0.3 | Good | Good |
| N,N-dimethyl-cyclohexylmethyl-amine | No difficulty | 0.3 | Good | Good |

All of the compounds were emulsified by means of sonication using the following procedures: For each 2 ml of compound there were added 0.4 gm Pluronic F68 and water to make a total volume of 9.5 ml. To this was added 1.0 ml of a concentrated electrolyte solution to bring osmolality to 290 mOs. This yielded 19% (v/v) emulsions.

Pluronic F68 is a commercial nonionic surfactant sold by Wyandotte Chemical Corp., having the chemical structure of a polyoxyethylene-polyoxypropylene copolymer having a molecular weight of about 5,000 to 15,000.

All of the synthesized compounds were tested to some extent. In some instances several different batches of the compound were tested. Toxicity considerations, however, made it necessary to rely on the least toxic ones for the most intensive animal tests.

To avoid erroneous interpretation of the results of biological testing in animals, it was considered essential to test the synthesized perfluorochemicals for toxicity by some means that circumvented effects due to emulsion particle size and emulsion stability. This could best be done by utilizing the neat perfluorochemical itself rather than first incorporating it into an emulsion. The toxicity test method chosen was that of tissue culture, using the unemulsified compounds. Perfluoro tributylamine was adopted as the routine standard in the tissue culture toxicity tests, because previous studies had shown it to be nontoxic even over six weeks of incubation with the cells.

In the tissue culture tests a number of the synthesized compounds were found to be quite toxic. Attempts were made to further purify these toxic compounds by repeated extraction with 5% NaOH and if this procedure was ineffective, extraction with cold 5% HCl was tried among other attempted means for removing possible impurities responsible for the toxicity.

Based on results of the tissue culture tests, the fluorinated compounds, before and after further purification, were rated as to toxicity levels, characterized respectively as *Nontoxic, Slightly, Moderately* and *Very Toxic* on the basis of percent viability and percent and of control multiplication at the particular concentration employed. The designation "non-toxic" was given to the product when its effect on cell multiplication was in the range of 85 to 100% of control growth; the designation "*very*" *toxic* was applied to those showing 0–34% of control growth.

The tissue culture tests showed one sample of N-N-dimethyl-n-hexylamine to be very toxic even at levels as low as 0.005 ml and even after extensive washing with KOH solution. Another sample, purified by ordinary distillation, was classified as *moderately toxic* at the 0.02 ml level (cell multiplication was 35% of the control and 95% of the cells were viable) and *very toxic* at the 0.1 ml level (cell destruction had occurred).

The more promising candidates of the synthesized fluorochemical compounds were included in animal testing studies. Among these was the compound of the present invention, perfluorinated N,N-dimethylcyclohexylmethylamine. Although this compound was not found to be free of toxicity as judged by tissue culture assay, it was found to have a minimal adverse effect on rats under the conditions of these tests. It was concluded that if the compound was further purified, it would likely have no residual toxicity.

The results of animal toxicity tests performed on certain of the synthesized fluorochemicals and the expiratory loss observed, are set out in Table 5.

These animal toxicity tests were carried out by intravenous injection through the tail vein of the test rat of an emulsion of the candidate fluorochemical and observing the immediate and subsequent effects, including changes in respiratory rate and skin color, weakness, abnormal movement, and so forth. Expiratory loss of fluorochemical was measured by placing the injected animals in gas tight chambers furnished with food and water, as well as with inlet and outlet tubes for filtered air supplied at a constant rate. The effluent air was passed through several absorption towers to collect any perfluorochemical present, and the amount was determined by gas-liquid chromotography.

The emulsions employed were the same as those which had been used in earlier reported investigations corresponding to the composition in Table 4. (See Geyer, R. P., New England J. Med. 289,1077 (1973).

TABLE 4

| COMPOSITION OF BLOOD SUBSTITUTE | |
|---|---|
| Constituent | 100 ml basis |
| Perfluorochemical | 11.0–13.0 ml |
| Pluronic F 68 | 2.3–2.7 g |

TABLE 4-continued

| COMPOSITION OF BLOOD SUBSTITUTE | |
|---|---|
| Constituent | 100 ml basis |
| Glucose (when present) | 0.1 g |
| Hydroxyethyl starch | 3.0 g |
| NaCl | 54 mg |
| KCl | 32 mg |
| $MgCl_2$ | 7 mg |
| $CaCl_2$ | 10 mg |
| $NaH_2PO_4$ | 9.6 mg |
| $Na_2CO_3$ | to pH 7.4 |
| $H_2O$ | to 100 ml |

TABLE 5

| Perfluorocarbon | Dose | Immediate Reaction | Subsequent Course | Expiratory Loss |
|---|---|---|---|---|
| N,N-dimethyl-cyclohexyl methyl-amine (VI) | 3.80 ml/kg body wt. 7.23 g/kg body wt. | All rats became quiet and their respiratory rate increased temporarily | (A) | The perfluorochemical appeared in the expired gases immediately. Rapid loss continued for at least 48 hours. Approximately 45% of the injected dose was lost within 3 days |
| N,N-dimethyl-cyclohexylamine (V) | 3.80 ml/kg body wt. 7.24 g/kg body wt. | The rats were affected almost immediately. Their respiratory rate increased and they became quiet. | (B) | The fairly rapid demise of the animals made measuring of the expiratory loss of the compound very difficult. However, perfluorochemical did appear in the expired gases in greater amounts than from the perfluoro N,N-dimethyl-n-hexylamine. |
| N,N-dimethyl-n-hexylamine (IV) | 3.80 ml/kg body wt. 6.97 g/kg body wt. | The animals were initially not affected. | (C) | Perfluorochemical appeared in the expired gases soon after injection and continued at a slow to moderate rate until the rats died. |

(A) After the initial effects, no further reactions were observed. No pathological changes were found when the animals were sacrificed.
(B) Although seemingly recovering, the rats again became very quiet, resembling those given the N,N-dimethyl-n-hexylamine. All animals died within 2 hours. The lungs were congested, and other organs were a dark color.
(C) Approximately 10 to 15 minutes after the injections, the animals became anxious and began to lose their usual pink color. They became very cyanotic by 40 minutes, and all died by 50–60 minutes. There was no lung bloating. All organs appeared congested.

The conclusions reached as to the animal toxicity results and other tests on the fluorochemicals listed in Table 5, can be summarized as follows:

Perfluoro-N,N-dimethylcyclohexylmethylamine (VI) has potential as a component of red cell replacement preparations. It forms stable emulsions and is lost from the body rapidly. The latter may result from the presence of the bulky cyclohexyl moiety adjacent to the heteroatom.

Perfluoro-N,N-dimethyl cyclohexylamine (V) like its normal analogue (IV) also proved to be toxic to rats. It is not clear whether this was due to the compound (V) itself or to contaminants present. It should be noted that the product compound (V) synthesized by electrofluorination of N,N-dimethyl cyclohexylamine contained approximately 75% of (V) and about 25% of (IV), formed by ring cleavage. It was not possible to separate the two by spinning band distillation nor by gas-liquid chromotography. As judged by the animal toxicity tests, perfluoro-N,N-dimethylcyclohexylamine is too toxic for use as a red cell substitute. It is, however, possible that the toxicity is due to contaminants such as perfluorinated dimethyl-n-hexylamine. Since (V) is less toxic than (IV) and leaves the body fairly rapidly, it would be worthwhile, if possible, to obtain really pure compound (V) for further tests.

Perfluoro-N,N-dimethyl-n-hexylamine (IV) is not a candidate for red cell replacement mixtures as judged by the present tests in animals and tissue culture. If subsequent studies show it can be rendered nontoxic and still be lost from the animals, its status in this regard would change.

The principal aim of the extensive study of fluorocarbons is to find the ideal one or more of such compounds forming stable emulsions that can be used for injection in mammals in place of natural blood. In this way problems associated with natural blood administration could be eliminated, such as the need for typing and cross-matching, and the risk of transmission of diseases such as hepatitis. The use of a synthetic blood substitute would obviate the high costs of collecting, handling, storing and distributing natural blood. Even those artificial blood products which do not meet the desired ideal enabling it to fully supplement natural blood for life-saving transfusions, may find use in other suggested applications. Thus such artificial blood substitutes are particularly suited as perfusates for organ preservation and consequent development of organ banks, which are severely limited at present by the brief in vitro life of red cells and plasma proteins. Another suggested use is in experimental chemotherapy, wherein such artificial blood substitute would permit the administration of test drugs that otherwise would react with constitutents of natural blood. Other suggested uses are set out in the cited paper by Riess et al at pages 631–632.

In addition to proposed biomedical uses, inert perfluorinated compounds find use as refrigerants, dielectric liquids, inert diluents for chemical reactions as heat transfer media, hydraulic mechanism fluids, and the like.

What is claimed:

1. A synthetic blood composition comprising a mammalian blood substitute aqueous emulsion containing an effective amount of perfluoro-N,N-dimethylcyclohexylmethylamine.

2. A composition as defined in claim 1 further comprising an emulsifying agent a nonionic surfactant having a molecular weight of 5,000 to 15,000.

3. A composition as defined in claim 1 further comprising as emulsifying agent a polyoxyethylene-polyoxypropylene copolymer, wherein the particle size is predominantly less than 0.3 microns.

4. A composition as defined in claim 1 wherein said emulsion comprises electrolyte in quantity sufficient to adjust the osmolality to about 290 mOs.

5. The method of preparing a stable emulsion, which comprises subjecting to sonication an aqueous mixture of perflouro-N-N-dimethylcyclohexylmethylamine and nonionic surfactant for a period of time sufficient to obtain a predominant particle size of less than 0.3 microns and few, if any, particles larger than 0.5 microns.

6. The method defined in claim 5 wherein the obtained emulsion is adjusted to an osmolality of about 290 mOs by addition of electrolyte.

7. An aqueous oxygen-transporting emulsion suitable for use as a blood substitute, which comprises 5 to 35% by volume of perfluoro-N,N-dimethyl-cyclohexylmethylamine emulsified in a physiologically acceptable aqueous medium with a nonionic surfactant as the emulsifying agent, said emulsion further containing water soluble electrolyte salts; the particle size of the emulsified material being substantially entirely not in excess of 0.3 micron.

* * * * *

UNITED STATES PATENT AND TRADEMARK OFFICE

CERTIFICATE OF CORRECTION

PATENT NO. : 4,325,972

DATED : 20 April 1982

INVENTOR(S) : Robert P. Geyer, Frederick L. Herman

It is certified that error appears in the above-identified patent and that said Letters Patent are hereby corrected as shown below:

On The Title Page, item (73) should read

--- Assignee: President and Fellows of
Harvard College
Cambridge, Massachusetts --.

Column 2, Line 24 should read "In carrying out the synthesis phase of the program, - - "

Signed and Sealed this

Sixth Day of July 1982

[SEAL]

Attest:

GERALD J. MOSSINGHOFF

Attesting Officer

Commissioner of Patents and Trademarks